US009966209B1

(12) United States Patent
Fasano

(10) Patent No.: US 9,966,209 B1
(45) Date of Patent: May 8, 2018

(54) CIRCUIT BREAKER WITH ARC SHIELD

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days. days.

(21) Appl. No.: 15/440,775

(22) Filed: Feb. 23, 2017

(51) Int. Cl.
*H01H 33/20* (2006.01)
*H01H 33/02* (2006.01)

(52) U.S. Cl.
CPC ..... *H01H 33/20* (2013.01); *H01H 33/027* (2013.01)

(58) Field of Classification Search
CPC ..... H01H 33/027; H01H 33/08; H01H 33/20; H01H 33/125; H01H 9/30; H01H 9/46; H01T 4/14
USPC ..... 218/148, 36, 40, 147, 146
See application file for complete search history.

(56) References Cited

U.S. PATENT DOCUMENTS 5,109,146 A 4/1992 Maenishi
6,417,474 B1 * 7/2002 Rakus ..... H01H 9/46 218/148
6,853,274 B2 * 2/2005 Millburn ..... H01H 73/38 335/6
7,586,057 B2 * 9/2009 Sisson ..... H01H 9/342 218/157
7,679,020 B2 3/2010 Schulz et al.
8,519,292 B2 8/2013 Domejean
8,822,866 B2 9/2014 Fasano
8,853,586 B2 10/2014 Theisen et al.
8,947,181 B2 2/2015 Malingowski et al.
9,263,216 B2 * 2/2016 Lin ..... H01H 9/48
2006/0163049 A1 * 7/2006 Puhalla ..... H01H 71/465 200/330
2012/0037598 A1 2/2012 Fasano
2012/0261382 A1 10/2012 Fasano
2013/0284702 A1 10/2013 Hamada et al.

* cited by examiner

*Primary Examiner* — Renee Luebke
*Assistant Examiner* — William Bolton
(74) *Attorney, Agent, or Firm* — Forge IP, PLLC

(57) ABSTRACT

A circuit interrupter having a first contact positioned on a moveable contact arm that is moveable into and out of physical contact with a stationary contact. An arc horn shield positioned on or affixed to an escapement that is coupled to the moveable contact arm, the arc horn shield including a substantially U-shaped tab that is provided as a protrusion with an arc receiving surface such that when the moveable contact is moved into the vicinity of the protrusion, any arc that may be formed between the contacts is passed from the moveable contact to the arc receiving surface to minimize damage to the moveable contact and extinguish the arc.

18 Claims, 3 Drawing Sheets

CIRCUIT BREAKER WITH ARC SHIELD

FIELD OF THE INVENTION

The invention relates to the field of circuit breakers. More specifically, the invention relates to a circuit breaker that includes an arc shield positioned on the escapement that motivates an arc off of the moveable contact.

BACKGROUND OF THE INVENTION

Circuit interrupters are electrical components that can be used to break an electrical circuit, interrupting the current flow. A basic example of a circuit interrupter is a switch, which generally consists of two electrical contacts in one of two states; either closed, meaning that the contacts are touching and electricity can flow between them, or open, meaning that the contacts are separated, and no electricity can flow between them. A switch may be directly manipulated by a human to provide a control signal to a system, such as a computer keyboard button, or to control power flow in a circuit, such as a light switch.

Another example of a circuit interrupter is a circuit breaker. A circuit breaker may be used, for example, in an electrical panel to limit the electrical current being sent through the electrical wiring. A circuit breaker is designed to protect an electrical circuit from damage caused by an overload or a short circuit. If a fault condition such as a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a terminal connected to a power supply, such as a power line from a power company, and another terminal connected to the circuit that the breaker is intended to protect. Conventionally, these terminals are referred to as the "line" and "load" respectively. The line may sometimes be referred to as the input into the circuit breaker. The load, sometimes referred to as the output, feeds out of the circuit breaker and connects to the electrical components being fed from the circuit breaker.

A circuit breaker may be used to protect an individual device, or a number of devices. For example, an individual protected device, such as a single air conditioner, may be directly connected to a circuit breaker. A circuit breaker may also be used to protect multiple devices by connecting to multiple components through a power wire which terminates at electrical outlets, for example.

A circuit breaker can be used as a replacement for a fuse. Unlike a fuse however, which operates once and then must be replaced, a circuit breaker can be reset (either manually or automatically) to resume normal operation. Fuses perform much the same circuit protection role as circuit breakers. However, circuit breakers may be safer to use in some circumstances than fuses, and may be easier to fix.

For example, in a situation where a fuse blows, interrupting power to a section of a building for example, it may not be apparent which fuse controls the interrupted circuit. In this case, all of the fuses in the electrical panel would need to be inspected to determine which fuse appears burned or spent. This fuse would then need to be removed from the fuse box, and a new fuse would need to be installed.

In this respect, circuit breakers can be much simpler to use than fuses. In a situation where a circuit breaker trips, interrupting power to a section of a building for example, it may be easily apparent which circuit breaker controls the interrupted circuit by looking at the electrical panel and noting which breaker has tripped to the "off" position. This breaker can then be simply flipped to the "on" position and power will resume again.

In general, a typical circuit interrupter has two contacts located inside of a housing. The first contact is stationary, and may be connected to either the line or the load. The second contact is movable with respect to the first contact, such that when the circuit breaker is in the "off" or tripped position, a gap exists between the first and second contact.

A problem with circuit interrupters that operate by separating contacts arises because the energized contacts separate when the circuit breaker is tripped, causing a gap to widen between the contacts while the movable contact moves from the closed position to the open position.

As the contacts begin to separate from the closed position, or approach complete closure from an open position, a very small gap exists between the contacts for a brief time while the contacts are closed or opened. An electric arc may be generated across this gap if the voltage between the contacts is high enough. This is because the breakdown voltage between the contacts is positively related to distance under pressure and voltage conditions in typical applications.

The creation of an arc during switching or tripping the circuit interrupter can result in undesirable side effects which can negatively affect the operation of the circuit interrupter, and which can create a safety hazard.

These effects can have consequences for the operation of the circuit interrupter. One possible consequence is that the arc may short to other objects in the circuit interrupter and/or to surrounding objects, causing damage and presenting a potential fire or electrocution safety hazard.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius) which can crack the surrounding gas molecules creating ozone, carbon monoxide, and other compounds. The arc can also ionize the surrounding gasses, potentially creating alternate conduction paths.

Because of these detrimental effects of arcing, it can be very important to quickly cool and quench the arc to prevent damage to the circuit interrupter.

Various techniques for transferring the arc away from the moveable contact are known. For example, it is known to provide arc transferring devices to draw an arc away from the contacts to limit the damage that may be done to the contact due to the heat buildup during the arcing process. However, since the arcing occur between the contacts, the devices known for drawing away the arcs have been positioned in the vicinity of the contact and typically on the moveable contact arm. However, a major disadvantage of this approach is that this adds weight (mass) to the moveable contact arm and that weight slows down the movement of the moveable contact arm as the heavier it is, the slower it will move with the same force applied to it. Even a relatively small (a few milliseconds) delay, can result is significant damage occurring to the contact as the heating caused by the arcing can severely damage the face of the contact.

Likewise, the arcing that occurs around the moveable contact can jump to the escapement and thereby heat and damage the escapement. This can be very serious because if the escapement is damaged too significantly, this can significantly slow the actuation of the moveable contact arm thereby causing still further damage to the system. Enough damage to the escapement can result in catastrophic failure opening mechanism.

Additionally, systems to draw an arc off of or away from the contacts can add significant cost and weight to the circuit interrupter. For example, an arm or other feature that may be positioned in close proximity to the moveable contact that may be positioned on the moveable contact arm may be used to draw and arch off of the moveable contact. However, this unfortunately, will add significant weight to the moveable contact arm. The increased mass will function to slow the operation of the contact arm. Even a small delay in opening the contacts can have a very large negative impact on the system.

It is therefore desired to provide an alternative system that is usable with a circuit interrupter that overcomes these limitations.

SUMMARY OF THE INVENTION

Accordingly, it is an object of the present invention to provide a circuit interrupter having a structure that functions to draw an arc that may develop in the gap between the contacts away from the contacts quickly and safely.

It is further desired to provide a system and method for protecting and shielding the escapement connected to the moveable contact arm when arcing occurs in a circuit interrupter when the contacts are opening.

It is further desired to provide a system and method for minimizing the arcing that occurs in a circuit interrupter that does not significantly impact the function, operation and cost of the circuit interrupter.

These and other objectives are achieved by providing a circuit interrupter that includes a first moveable contact and a second stationary contact that are movable into and out of contact with each other. The circuit interrupter further includes an escapement mechanically coupled to toward a first end of the moveable contact arm and the escapement coupled at another end to a handle. The moveable contact arm is still further mechanically connected at a second end to a linkage where the movement of the linkage is governed by an overcurrent device. An arc horn shield is connected to the escapement wherein an arc horn extends from the arc horn shield towards the moveable contact such that an arc that develops between the stationary contact and the moveable contact is drawn away from the moveable contact and onto the arc horn.

In one configuration, the arc horn extends from a side of the arc horn shield and comprises a substantially U-shaped extension. In this configuration, the arc horn essentially comprises a flat tab that is bent backward to create an arc receiving surface that, as the moveable contact opens, become essentially parallel with the moveable contact arm. As the moveable contact moves into the vicinity of the arc receiving surface, the arc is pulled toward the arc receiving surface from the moveable contact.

In another configuration, the arc horn is provided as a substantially flat U-shaped tab that extends from a lateral surface of the arc horn shield and is bent backwards upon itself. When the moveable contact arm is opened, the end of the moveable contact arm that holds the moveable contact moves into the vicinity of the arc horn and passes below the bottom portion of the U-shaped tab. Any arc that may be present on the moveable contact when opening will be transferred or drawn to the arc receiving surface of the arc horn.

A primary benefit of this configuration is that the arc horn shield may be provided as a robust device that is capable of handling a strong arc. One of the major difficulties that circuit interrupters face is that arc quenching devices must be robust (have sufficient mass) to withstand arcing and the associated damage that can occur due to the heat buildup caused by the arcing. However, when the size and weight of the arc quenching device is increased, this has a dramatic negative effect on the ability of the moveable contact arm to quickly and effectively open the contact to break the arc that may occur. So, arc quenching devices have been reduced in size and weight to minimize the negative effect on the moveable contact arm, but this in turn, has lowered the lifespan and effectiveness of the arc quenching device as the smaller and lighter weight devices are, 1) not as effective in motivating an arc off of the moveable contact; and 2) more subject to wear and damage. Additionally, the more wear and damage that occurs to the arc quenching device, the less effective the device becomes further exacerbating the problem. This problem is addressed, however, in the current configuration by positioning the arc horn shield not on the moveable contact arm, but rather, on the escapement.

By positioning the arc horn shield on the escapement, the mass (weight) of the moveable contact arm is not increased and therefore the speed in which the moveable contact can be opened is not negatively impacted. To achieve the benefits of motivating an arc that may form when opening the contact, the escapement needs to be positioned in such a manner that the moveable contact comes into close proximity with the escapement. This however, creates the potential that arcing and the heat associated therewith, may damage the escapement. Accordingly, the arc horn shield is formed in such a manner that it extends substantially around three sides of the escapement (the side facing the moveable contact and the two opposing lateral sides). By forming the arc horn shield in this manner, the escapement is substantially encased in the arc horn shield to prevent any damage from occurring due to potential arcing.

The arc horn shield can comprise any material that is highly conductive (e.g., essentially any type of metal or alloy material) and is coupled to ground so as to dissipate any arc that may be drawn onto the arc horn.

For this application the following terms and definitions shall apply:

The term "network" as used herein includes both networks and internetworks of all kinds, including the Internet, and is not limited to any particular network or inter-network.

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one embodiment, a circuit interrupter is provided comprising a set of contacts including a stationary contact and a moveable contact, and a contact arm having a first end and a second end, the moveable contact positioned at the first end. The circuit interrupter further comprises a linkage coupled to the second end of the contact arm, the linkage coupled to an overcurrent measurement device and to a handle. The circuit interrupter still further comprises an escapement coupled at a first end to the contact arm at a location between the first and second ends of the contact arm, the escapement coupled at a second end to the handle, wherein actuation of the handle causes the moveable contact arm to move to either open or close the set of contacts. Finally, the circuit interrupter comprises an arc horn shield mounted onto the escapement, the arc horn shield including an protrusion extending from a side portion thereof in the form of a tab that includes an arc receiving surface such that when the moveable contact arm is displaced to an open position, the moveable contact is moved into the vicinity of the arc receiving surface.

In another embodiment, a circuit interrupter is provided comprising a stationary contact, a moveable contact and a contact arm having a first end and a second end, the moveable contact positioned toward the first end. The circuit interrupter further comprises a handle and an escapement coupled at one end to a point along a length of the contact arm and at another end to the handle, wherein actuation of the handle causes the moveable contact arm to move the moveable contact into and out of physical contact with the stationary contact. The circuit interrupter still further comprises an arc horn shield mounted onto the escapement, the arc horn shield including an protrusion extending from a side portion thereof in the form of a tab that includes an arc receiving surface such that when the moveable contact arm is displaced to an open position, the moveable contact is moved into the vicinity of the arc receiving surface.

Other objects of the invention and its particular features and advantages will become more apparent from consideration of the following drawings and accompanying detailed description.

DETAILED DESCRIPTION OF THE INVENTION

Figure 1:
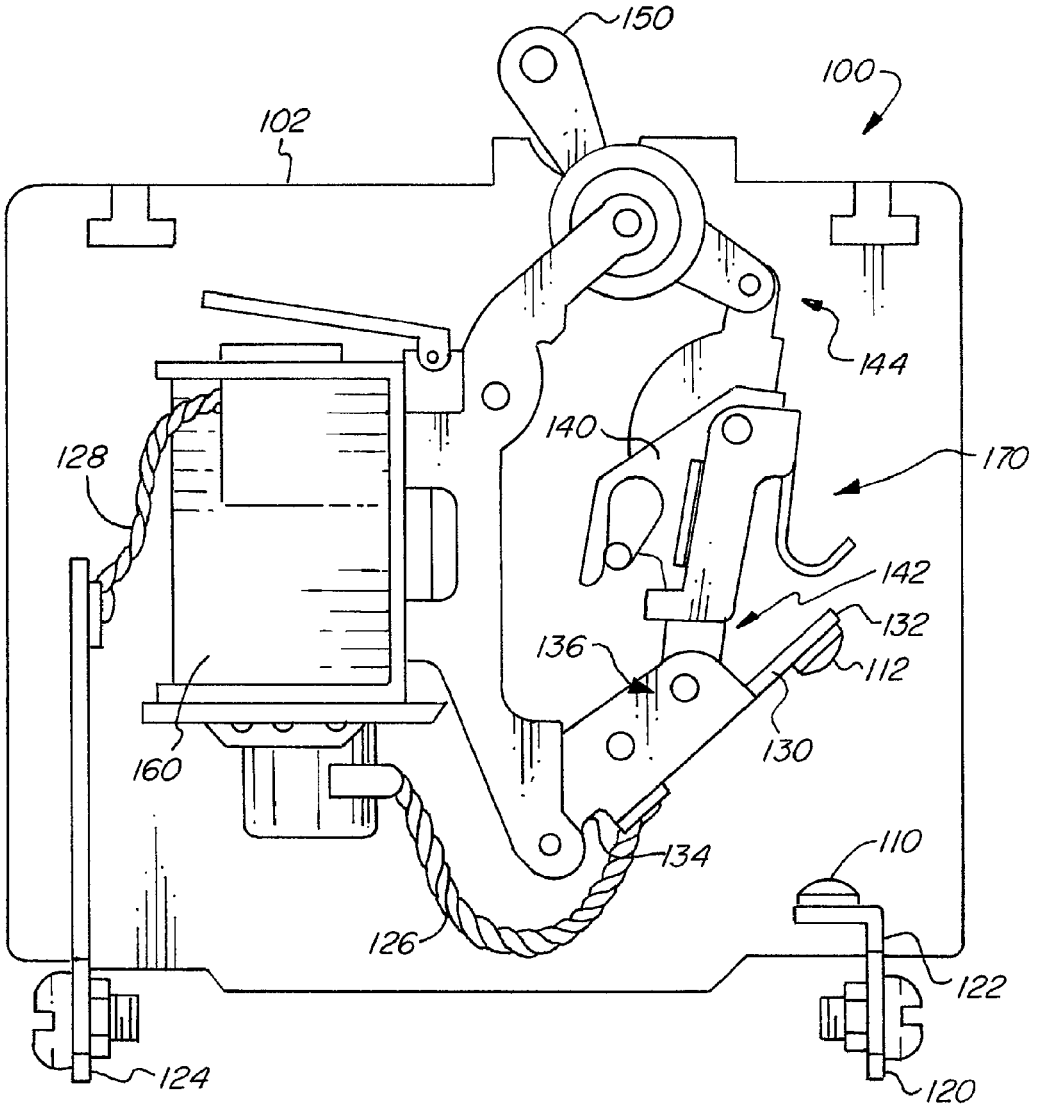
FIG. 1 is an illustration of a configuration for the circuit interrupter according to the invention.

Referring now to the drawings, wherein like reference numerals designate corresponding structure throughout the views.

FIG. 1 illustrates components of an example circuit interrupter 100 according to aspects of the invention.

Circuit interrupter 100 may be any device which can be used to make and break a circuit using contacts. For example, it will be clear to those having ordinary skill in the art that circuit interrupter 100 may be a simple switch, or may be implemented as a circuit breaker having a housing 102, for example. Housing 102 may include vents to allow gasses and debris produced by arcing to escape housing 102.

Circuit interrupter 100 includes a stationary contact 110 that is electrically connected to line terminal 120 through conductor 122. The line terminal receives electricity from a power source, such as, a generator (not shown), which in some applications is supplied by a power company.

Circuit interrupter 100 still further includes a moveable contact 112 mounted on moveable contact arm 130. The moveable contact 112 is positioned toward a first end 132 of the moveable contact arm 130. The moveable contact arm 130 further includes a second end 134 that is opposite the first end 132.

Moveable contact arm 130 is, in turn, connected to escapement 140, which includes a first end 142 and a second end 144. The first end 142 of escapement 140 is connected to the moveable contact arm at a location along a length of the moveable contact arm and preferably toward a mid-point 136 thereof.

The second end 144 of escapement 140 is connected to a handle 150 that extends from housing 102.

First movable contact 112 is connected to load terminal 124 through a conductor 126 to overcurrent measurement device 160 and through conductor 128. The overcurrent measurement device 160 may be any type of well-known device for measuring current that passes through the circuit interrupter 100. Once a maximum current is reach, the measurement device will function to cause the contact arm 130 to move to an open position. Likewise, the handle 150 will move to an intermediate position to indicate a "tripped" state of circuit interrupter 100.

Also illustrated in FIG. 1 is arc horn shield 170, which is mounted to or on escapement 140. Arc horn shield 170 may comprise any conductive material including, but not limited to, a metal or alloy material.

Figure 2:
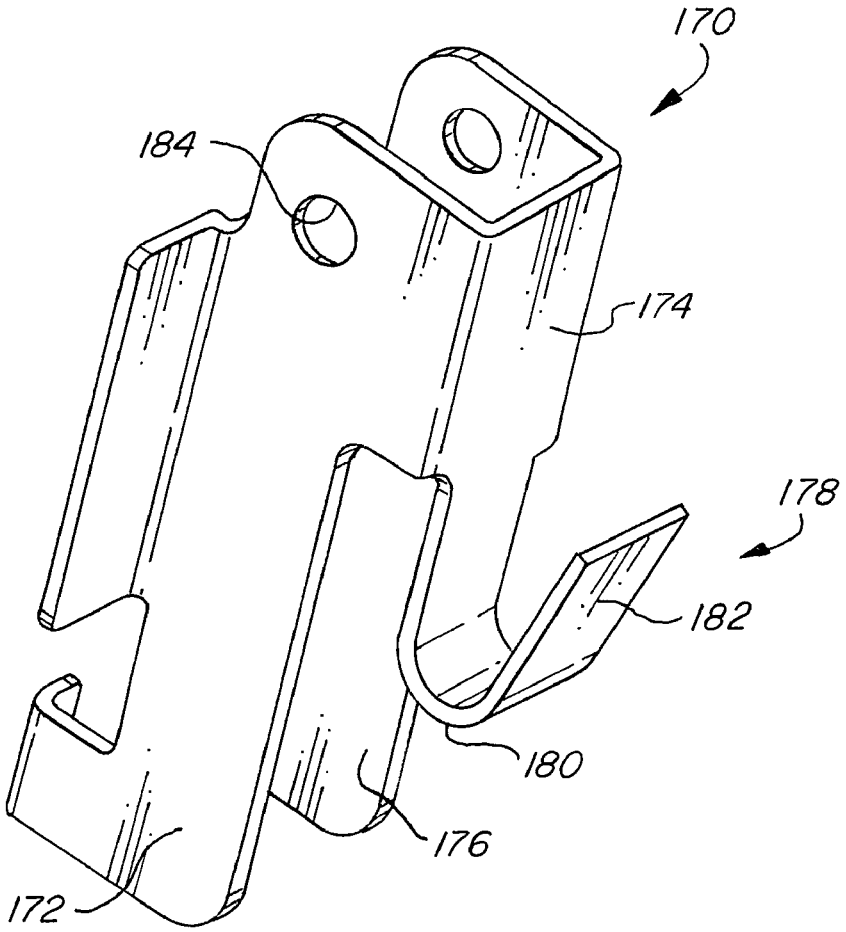
FIG. 2 is an illustration of the arc horn shield according to FIG. 1.

The arc horn shield will now be discussed in connection with FIGS. 1 and 2. Arc horn shield 170 is provided as an elongated device that includes a first side 172, a second side 174 and a third side 176. The second side 174 includes a protrusion 178 that is formed as a substantially U-shaped tab. The substantially U-shaped tab has a curved portion 180 that corresponds with the bottom of the U, and an arc receiving surface 182 that comprises a substantially flat surface.

As can be seen with reference to FIG. 1, arc horn shield 170 is mounted to escapement 140 and substantially surrounds three sides of escapement 140. Mounting holes 184 are provided on the first side 172 and the third side 176 for affixing arc horn shield 170 to escapement 140.

Figure 3:
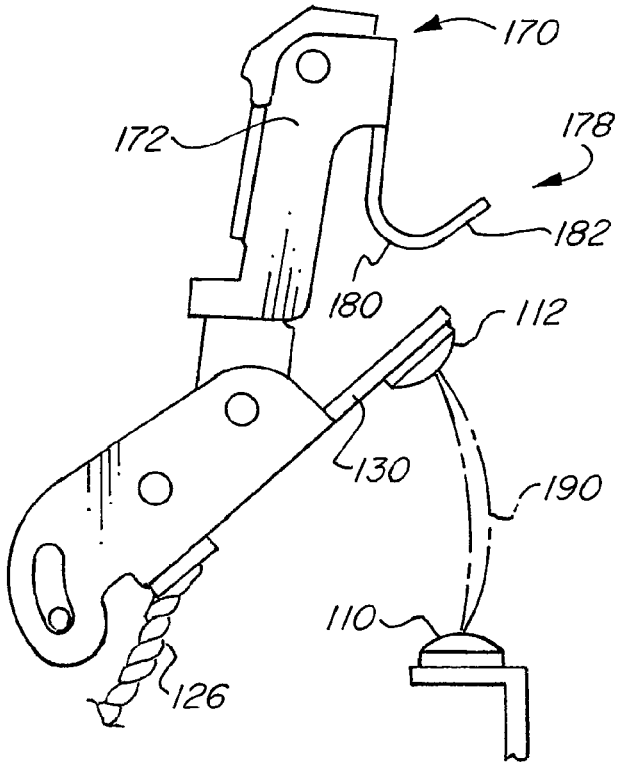
FIG. 3 is an illustration of the moveable contact arm opening the contacts with an arc shown between the contacts according to FIG. 1.
Figure 4:
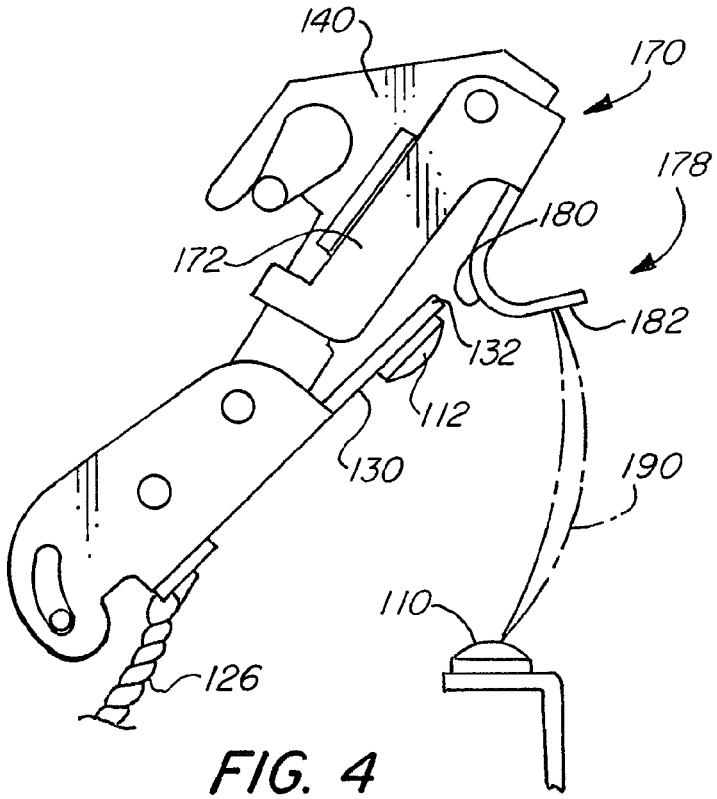
FIG. 4 is an illustration of the moveable contact arm opening the contacts with an arc shown between the stationary contact and the arc horn according to FIG. 1.

Turning also now to FIGS. 3 and 4, it can be seen that first side 172 (and corresponding third side 176) are provided as substantially L-shaped (upside down L in FIG. 3) with the protrusion 178 extending from the second side 174. The protrusion 178 is formed as a tab that is bent backward upon itself.

The function and operation of the circuit interrupter 100 including the arc horn shield 170 will now be discussed.

In FIG. 3, the opening of the moveable contact arm 130 is illustrated. When moveable contact 112 is moved away from stationary contact 110 and current if flowing between the set of contacts, the current will continue to flow as the contacts move from a closed position to an open position. The result of this current flowing through the gap that forms between the set of contacts forms an arc 190.

The moveable contact arm is rotated upward such that moveable contact 112 is moved away from stationary contact 110. In FIG. 4 it can be seen that the first end 132 of moveable contact arm 130 moves toward protrusion 178, the arc 190 is "passed" from moveable contact 112 to arc receiving surface 182 of protrusion 178. As seen in FIG. 3, the moveable contact arm comes substantially parallel with arc receiving surface 182 as the first end 132 of moveable contact arm 130 comes into the vicinity of the protrusion 178.

In FIG. 4 it can be seen that the first end 132 of moveable contact arm 130 passed by or under curved portion 180. As stated previously, arc horn shield 170 is mounted to escapement 140 and substantially surrounds three sides of escapement 140. The positioning of the arc horn shield 170 is provided to protect escapement. As the moveable contact 112 moves toward and into the vicinity of the escapement 140, the arc 190, which causes a relatively large amount of heat to be generated, debris may be melted off of the contacts and migrate or be flung into the mechanism, and in particular, escapement 140, can destroy or seriously damage escapement 140. Accordingly, arc horn shield 170 provides protection physical protection to escapement 140 either directly from arc 190 or from debris that may be flung from the heating that occurs due to the arcing.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter comprising:

a set of contacts including a stationary contact and a moveable contact;

a contact arm having a first end and a second end, said moveable contact positioned at the first end;

a linkage coupled to the second end of said contact arm, said linkage coupled to an overcurrent measurement device and to a handle;

an escapement coupled at a first end to said contact arm at a location between the first and second ends of said contact arm, said escapement coupled at a second end to the handle, wherein actuation of the handle causes said moveable contact arm to move to either open or close said set of contacts; and an arc horn shield mounted onto said escapement, said arc horn shield including a protrusion extending from a side portion thereof defined by a tab that includes an arc receiving surface such that when the moveable contact arm is displaced to an open position, said moveable contact is moved into a vicinity of the arc receiving surface.

2. The circuit interrupter of claim 1, wherein said arc horn shield is formed as an elongated device comprising a first side, a second side and a third side, said protrusion extending from said second side and said first and third sides are substantially parallel with respect to each other.

3. The circuit interrupter of claim 2, wherein said tab is formed as a substantially U-shaped tab.

4. The circuit interrupter of claim 3, wherein when the moveable contact arm is moved to an open position, the first end of the contact arm passes below a curved portion of the substantially U-shaped tab.

5. The circuit interrupter of claim 3, wherein when the moveable contact arm is moved to an open position, during an opening process, the arc receiving surface become substantially parallel with the moveable contact arm when the first end of the moveable contact arm comes into the vicinity of the arc receiving surface.

6. The circuit interrupter of claim 5, wherein when the moveable contact arm is moved to the open position, the first end of the moveable contact arm advances beyond the arc receiving surface when the moveable contact arm reaches a fully open position.

7. The circuit interrupter of claim 2, wherein said arc horn shield is mounted on said escapement such that a portion of the escapement in the vicinity of the first end of said moveable contact arm when the contact arm is moved to the open position is substantially enclosed within said arc horn shield.

8. The circuit interrupter of claim 2, wherein the first and third sides are substantially L-shaped.

9. The circuit interrupter of claim 1, wherein said arc horn shield comprises a metal material or an alloy material.

10. A circuit interrupter comprising:

a first stationary contact;

a second moveable contact;

a contact arm having a first end and a second end, said moveable contact positioned toward the first end;

a handle;

an escapement coupled at one end to a point along a length of said contact arm and at another end to said handle, wherein actuation of said handle causes said moveable contact arm to move said moveable contact into and out of physical contact with said stationary contact; and an arc horn shield mounted onto said escapement, said arc horn shield including a protrusion extending from a side portion thereof defined by a tab that includes an arc receiving surface such that when the moveable contact arm is displaced to an open position, said moveable contact is moved into a vicinity of the arc receiving surface.

11. The circuit interrupter of claim 10, wherein said arc horn shield is formed as an elongated device comprising a first side, a second side and a third side, said protrusion extending from said second side and said first and third sides are substantially parallel with respect to each other.

12. The circuit interrupter of claim 11, wherein said tab is formed as a substantially U-shaped tab.

13. The circuit interrupter of claim 12, wherein when the moveable contact arm is moved to an open position, the first end of the contact arm passes below a curved portion of the substantially U-shaped tab.

14. The circuit interrupter of claim 12, wherein when the moveable contact arm is moved to an open position, during an opening process, the arc receiving surface become substantially parallel with the moveable contact arm when the first end of the moveable contact arm comes into the vicinity of the arc receiving surface.

15. The circuit interrupter of claim 14, wherein when the moveable contact arm is moved to the open position, the first end of the moveable contact arm advances beyond the arc receiving surface when the moveable contact arm reaches a fully open position.

16. The circuit interrupter of claim 11, wherein said arc horn shield is mounted on said escapement such that a portion of the escapement in the vicinity of the first end of said moveable contact arm when the contact arm is moved to the open position is substantially enclosed within said arc horn shield.

17. The circuit interrupter of claim 11, wherein the first and third sides are substantially L-shaped.

18. The circuit interrupter of claim 11, further comprising a linkage coupled to the second end of said contact arm, said linkage coupled to an overcurrent measurement device and to the handle, wherein said overcurrent measurement device functions to actuate said moveable contact arm to an open position when an overcurrent condition is detected.

* * * * *